US006135586A

United States Patent [19]

McClelland et al.

[11] Patent Number: 6,135,586

[45] Date of Patent: *Oct. 24, 2000

[54] LARGE AREA INKJET PRINTHEAD

[75] Inventors: Paul H. McClelland, Monmouth; Douglas A. Sexton, Corvallis, both of Oreg.; Kit Baughman, Escondido, Calif.; Marvin G. Wong, Corvallis, Oreg.; Eldurkar Bhaskar, Corvallis, Oreg.; Marzio Leban, Corvallis, Oreg.

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/551,266

[22] Filed: Oct. 31, 1995

[51] Int. Cl.[7] ..... B41J 2/155

[52] U.S. Cl. ..... 347/42

[58] Field of Search ..... 347/50, 57, 58, 347/59, 42; 361/749

[56] References Cited

U.S. PATENT DOCUMENTS

| | | | |
|---|---|---|---|
| Re. 32,572 | 1/1988 | Hawkins et al. | 156/626 |
| 4,153,518 | 5/1979 | Holmes et al. | 204/38 B |
| 4,612,554 | 9/1986 | Poleshuk | 346/140 R |
| 4,626,872 | 12/1986 | Takeno | 346/76 PH |
| 4,680,859 | 7/1987 | Johnson | 29/611 |
| 4,994,825 | 2/1991 | Saito et al. | 347/47 |
| 5,016,023 | 5/1991 | Chan et al. | 347/42 |
| 5,066,533 | 11/1991 | America et al. | 428/156 |
| 5,098,503 | 3/1992 | Drake | 156/299 |
| 5,160,403 | 11/1992 | Fisher et al. | 156/633 |
| 5,160,945 | 11/1992 | Drake | 346/140 R |
| 5,192,959 | 3/1993 | Drake et al. | 346/140 R |
| 5,218,754 | 6/1993 | Rangappan | 29/611 |
| 5,221,397 | 6/1993 | Nystrom | 156/273.5 |
| 5,229,785 | 7/1993 | Leban | 347/47 |
| 5,365,645 | 11/1994 | Walker et al. | 29/25.35 |
| 5,388,326 | 2/1995 | Beeson et al. | 29/611 |
| 5,495,076 | 2/1996 | Davis | 174/254 |
| 5,565,900 | 10/1996 | Cowger et al. | 347/42 |
| 5,610,642 | 3/1997 | Nobel et al. | 347/50 |
| 5,646,660 | 7/1997 | Murray | 347/59 |

FOREIGN PATENT DOCUMENTS

| | | | |
|---|---|---|---|
| 0512799 A2 | 5/1992 | European Pat. Off. | B41J 2/155 |
| 0564102 A2 | 3/1993 | European Pat. Off. | B41J 2/16 |

OTHER PUBLICATIONS

"Quasi–Static Modeling Of The Self–Alignment Mechanism In Flip–Chip Soldering—Part 1: Single Solder Joint", by S. K. Patra & Y. C. Lee, Journal of Electronic Packaging, Dec. 1991, vol. 113, pp 337–342.

"KYOCERA—Input Output Devices", KYOCERA Corporation Brochure, pp 1–12.

"An Innovative Bonding Technique For Optical Chips Using Solder Bumps That Eliminate Chip Positioning Adjustments", by Tsuyoshi Hayashi, IEEE Transactions On Components, Hybrids, and Manufacturing Technology, vol. 15, No. 2, Apr. 1992 Issue, pp 225–230.

*Primary Examiner*—John Barlow
*Assistant Examiner*—Juanita Stephens

[57] ABSTRACT

A pagewide printhead for an inkjet printer employs a stretch-to-fit flex circuit with orifices indexed to reference indentations on the flex circuit. Heater resistors disposed on a block of thermally stable insulating material are indexed to reference features accurately located on the block. The reference indentations are fitted to the reference indentations to provide accurate registration of the orifices to the heater resistors.

28 Claims, 5 Drawing Sheets

SECTION B - B

SECTION A - A

SECTION C - C

LARGE AREA INKJET PRINTHEAD

The present invention is generally related to a printhead for an inkjet printer and is more particularly related to a large area printhead otherwise known as a pagewide printhead which has the capability of depositing a full line or swath of ink across an entire page. The present application is related to U.S. patent application Ser. No. 08/550,698 titled Printhead With Pump Driven Ink Circulation, filed on behalf of Paul H. McClelland et al. on the same day as the present application and assigned to the assignee of the present invention.

BACKGROUND OF THE INVENTION

Inkjet printing has become widely known and is most often implemented using thermal inkjet technology. Such technology forms characters and images on a medium, such as paper, by expelling droplets of ink in a controlled fashion so that the droplets land on the medium. The printer, itself, can be conceptualized as a mechanism for moving and placing the medium in a position such that the ink droplets can be placed on the medium, a printing cartridge which controls the flow of ink and expels droplets of ink to the medium, and appropriate hardware and software to position the medium and expel droplets so that a desired graphic is formed on the medium. A conventional print cartridge for an inkjet type printer comprises an ink containment device and an ink-expelling apparatus, commonly known as a printhead, which heats and expels ink droplets in a controlled fashion. Typically, the printhead is a laminate structure including a semiconductor or insulator base, a barrier material structure which is honeycombed with ink flow channels, and an orifice plate which is perforated with nozzles or orifices with diameters smaller than a human hair and arranged in a pattern which allows ink droplets to be expelled. In an inkjet printer the heating and expulsion mechanism consists of a plurality of heater resistors formed on the semiconductor or insulating substrate and associated with an ink chamber formed in the barrier layer and one of the orifices in the orifice plate. Each of the heater resistors is connected to the controlling mechanism of the printer such that each of the resistors may be independently energized to quickly vaporize to expel a droplet of ink.

Most currently available thermal inkjet printers utilize a print cartridge which has a relatively small printhead (approximately 5 mm×10 mm) adjacent the media to be printed upon. The cartridge also contains a volume of ink which is coupled to the printhead. The entire print cartridge, including the volume of ink, is caused to shuttle back and forth across the width of a page of medium, laying down a swath of printed ink as the cartridge is moved across the page. Once the cartridge reaches the end of its print line, the medium is advanced perpendicularly to the direction of shuttle and another swath of ink is printed across the page. Moving the mass of ink contained in the print cartridge across the page places a limit on the speed at which the page can be printed and also constrains the amount of ink which can be stored in a print cartridge.

One technique which reduces or eliminates the shuttling of the print cartridge back and forth across the whole page is to utilize a printhead which is at least as wide as the media upon which print is to be placed, i.e. a page-wide printhead. Such an apparatus would print one or more lines at one time as the media is advanced, line by line, in a direction perpendicular to the long axis of the page-wide printhead. One such page-wide printhead has been described in U.S. patent application Ser. No. 08/192,087 "Unit Printhead Assembly For Ink-Jet Printing" filed on behalf of Cowger et al. on Feb. 4, 1994. This page-wide printhead employs a plurality of substrate modules aligned across the long axis of the page-wide printhead to enable easy replacement should one of the modular printheads suffer a failure.

One inherent problem with conventional page-wide printheads is that of manufacturability and thermal stability across the width of a page. In printers designed for office or home use, the width of a page-wide printhead equals 22 cm or more. In order to print with acceptable print quality, a page-wide printhead may have approximately 4800 printing orifices extending along the long dimension of the pagewide printhead. Because these orifices are small and misregistration of one orifice to another creates objectionable degredations in the quality of printing, it is important that the orifices be assembled with exceptional dimensional care and that the dimensions are held relatively constant over variations in temperature. Adding further to the temperature instability is the use of several different materials in the assembly of a conventional page-wide printhead. The printhead body typically is manufactured from plastic or metallic materials, upon which silicon substrates containing the firing resistors are affixed. The substrates are interconnected with a polyimide or other flexible polymer material. Each of these materials has a different coefficient of thermal expansion which leads to unacceptable misregistration of nozzles with temperature changes. An improperly matched set of materials can lead to rapid failure of a page-wide printhead. U.S. patent application Ser. No. 08/375,754 "Kinematically Fixing Flex Circuit to PWA Printbar" filed on behalf of Hackleman on Jan. 20, 1995, addresses one technique of accounting for thermal expansion of various materials used in a page-wide printhead. Furthermore, U.S. patent application Ser. No. 08/516,270 "Pen Body Exhibiting Opposing Strain To Counter Thermal Inward Strain Adjacent Flex Circuit" filed on behalf of Cowger on Aug. 17, 1995, provides an example of a plastic printhead body which may be designed to compensate the difference in thermal expansion of the various materials used in its construction.

The foregoing improvements notwithstanding, a page-wide printhead including precision manufacturing tolerances, thermal stability, and low cost is a highly prized but yet unrealized goal of inkjet printer designers.

SUMMARY OF THE INVENTION

A printer printhead has a thermally stable base with a plurality of first alignment features and a first surface defined by a long dimension and a short dimension. A plurality of essentially collinear heater resistors are disposed on the first surface of the thermally stable base, essentially parallel to the long dimension, and in correspondence with the plurality of first alignment features. The printhead also includes an orifice layer. The orifice layer has at least one expansion feature, a plurality of second alignment features, and a plurality of orifices essentially equal in number to the plurality of essentially collinear heater resistors. The plurality of second alignment features are arranged in correspondence with the plurality of orifices and are disposed alternate the plurality of first alignment features. Thus, the plurality of orifices are aligned with the plurality of essentially collinear heater resistors when the at least one expansion feature is expanded and the orifice layer is affixed to the first surface of the thermally stable base.

DETAILED DESCRIPTION OF A PREFERRED EMBODIMENT

Figure 1:
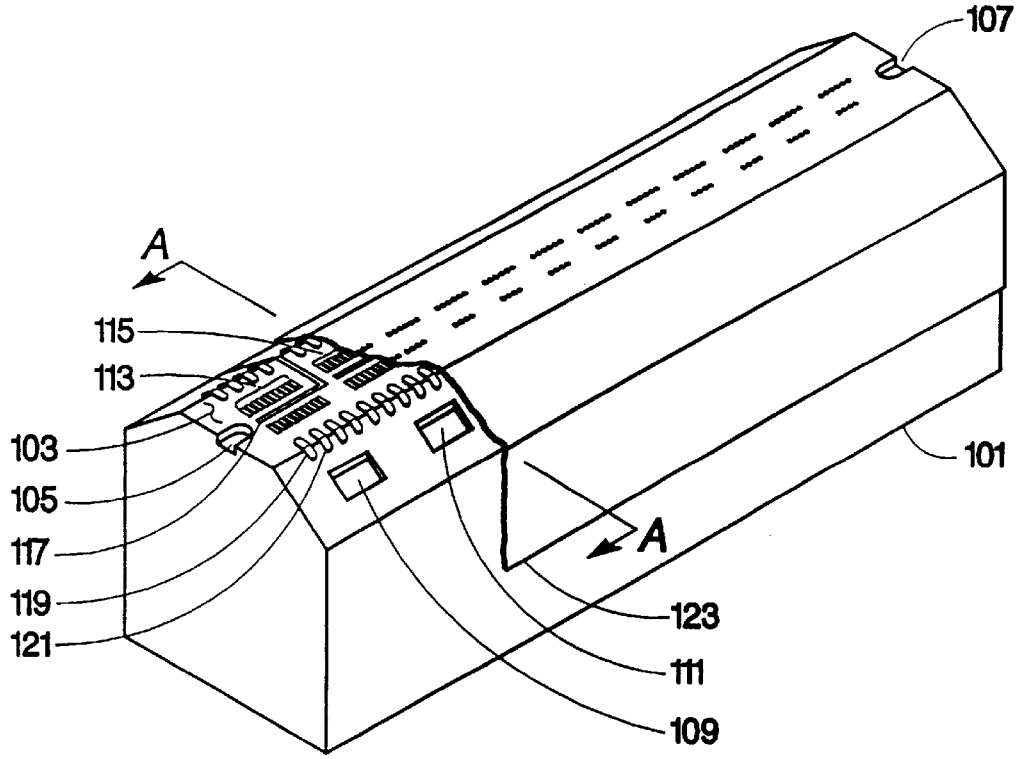
FIG. 1 is an isometric view of a large area printhead which illustrates the orientation of heater resistors and driver circuitry in cutaway and which may employ the present invention.
Figure 2:
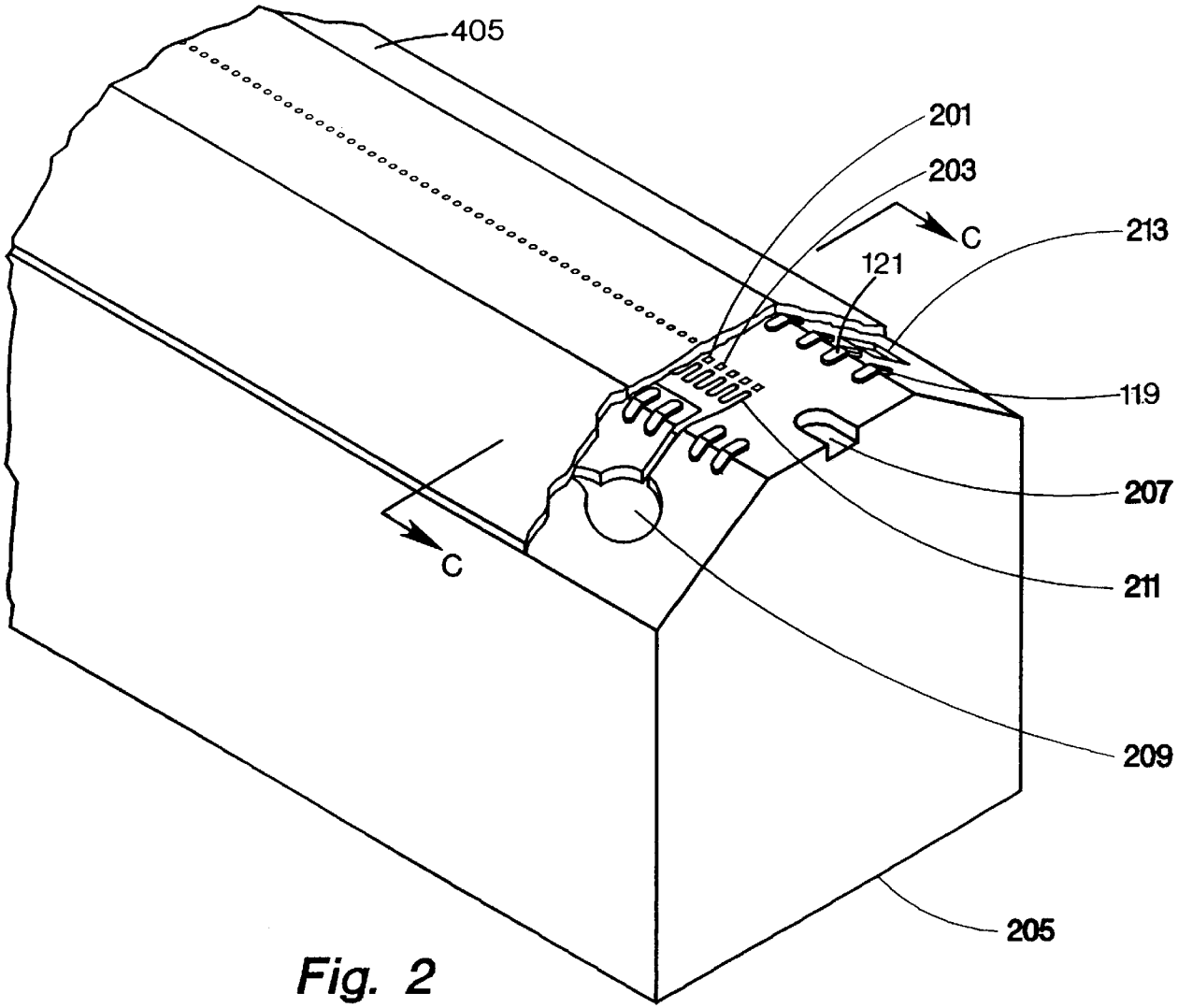
FIG. 2 is an isometric view of an alternative embodiment of the large area printhead of FIG. 1.

A page-wide large area printhead which may employ the present invention is shown in the isometric view of FIG. 1. A base of thermally stable material, such as fused high silica glass in the preferred embodiment, is cast into a elongate block 101 having approximate dimensions of 24 cm long by 2.5 cm high by 0.5 cm wide. One surface, a first surface 103 of the thermally stable base block 101 is used as the printing surface and it is upon this surface that the heater resistors and other elements of the printing mechanism are constructed. The fused high silica glass is molded into its desired shape and two reference notches 105 and 107 are molded into opposite ends of the printhead base as shown. Also molded into the printhead base is an ink plenum and manifold which will be described later, and indentations 109 and 111 in another, second, surface which are employed to house integrated circuits for energizing and controlling heater resistors. Groups of heater resistors 113 and 115 are deposited upon the block 101 by conventional sputtering techniques (but conventional evaporation or chemical vapor deposition may also be used) and are arranged, in the preferred embodiment, in two collinear rows extending from one end of the page-wide printhead to the other end. These collinear resistors are aligned parallel to a reference line created between reference notches 105 and 107. This technique results in the heater resistors being deposited with a registration of from 2 microns to 5 microns from one end of the printhead to the other. In order to realize high quality printing, in the preferred embodiment, there are approximately 4800 heater resistors in total. Each of the groups of heater resistors 113 and 115 are arranged around an ink feed channel 117 which is disposed between the two collinear rows of resistors for each resistor group and which provides ink to the firing chamber of each heater resistor as needed. Although the thermally stable base block 101 is constructed of fused silica glass in the present invention, other thermally stable insulators such as ceramic could also be used for the printhead base in the present invention. Alternatively, the heater resistors are constructed first in a plurality of silicon substrates which are then affixed to the thermally stable material of the block 101. In an alternative embodiment of the present invention, the thin film heater resistors (for example, heater resistors 201 and 203) are arranged in a single row as illustrated in FIG. 2. (It is well known that a single row may, in fact, have a slight stagger—see, for example, U.S. Pat. No. 5,519,423). The block of high silica glass 205 has a alignment feature reference notch 207, molded at each end of the block 205 as shown in FIG. 1 and has an ink plenum and manifold 209 molded into one of the side surfaces of the block 205. Each heater resistor is supplied ink by way of individual ink feed channels, for example ink feed channel 211 corresponding to ink feed channel 117 of FIG. 1, from the ink plenum and manifold 209. An indentation 213 is molded into the block 205 to accept an electronic integrated circuit for control and energizing the heater resistors.

Figure 3:
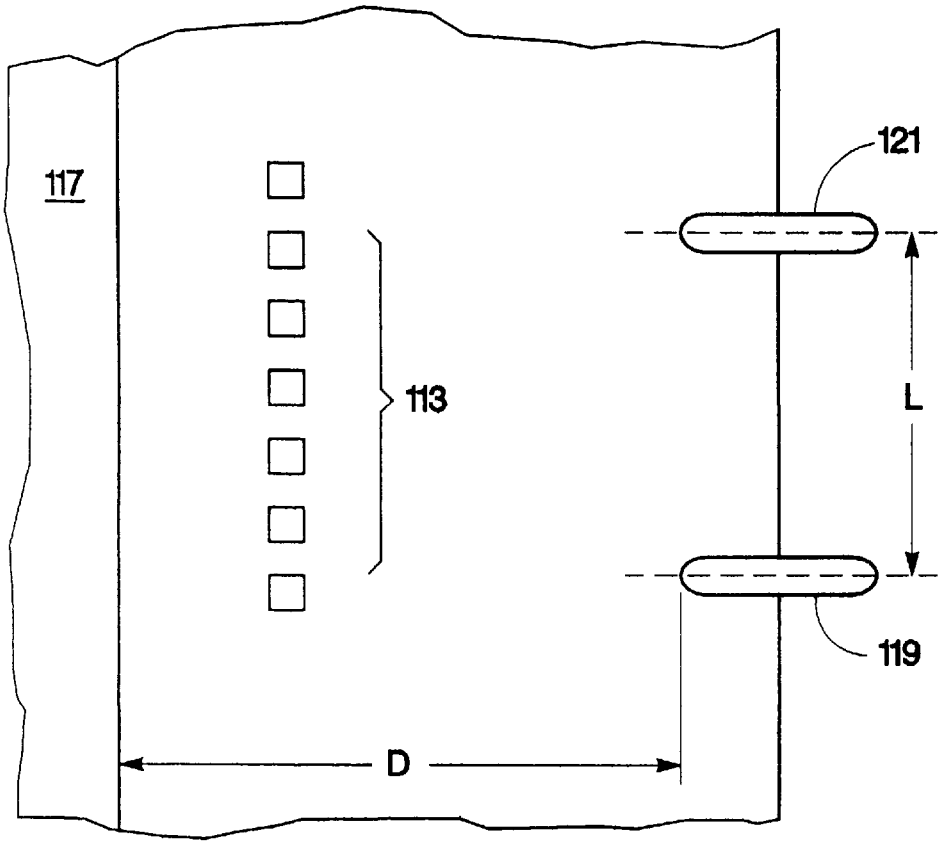
FIG. 3 is planar view of the print surface of the printhead of FIG. 1 which illustrates heater resistors and alignment features which may be employed in the present invention.

It is an important feature of the present invention that with the deposition of the heater resistors, a plurality of reference alignment features 119 and 121, for example, are created along the edge of the printhead surface by being molded into the block 101 or 205. In the preferred embodiment, the block 101 or 205, notches 105, 107, and 207, and reference features (for example, reference features 119 and 121) are molded at the same time. As an alternative manufacturing technique, the block 101 or 205 and the notches 105, 107, and 207 may be contemporaneously molded and the reference features may be subsequently formed by surface grinding, etching, or similar process. Such a subsequent process must use an indexing technique to provide close tolerances between the reference features and notches 105, 107, and 207. Furthermore, the heater resistors are indexed to the reference features with a precision of approximately 2 microns. In the preferred embodiment, the reference features are raised, elongated protrusions extending 20 microns above the surface 103 of the block 101 and filter extend approximately 2 mm beyond the plane of surface 103 and onto a side surface of block 101. The width of the reference feature is approximately 0.4 mm and the total length of each reference feature is approximately 4 mm. In the preferred embodiment the reference features, for example 119 and 121, are separated by a distance of $L \cong 5.0$ mm and are displaced from the edge of the ink fill slot 117 by a distance of $D \cong 4.5$ mm, as shown in FIG. 3.

Figure 4:
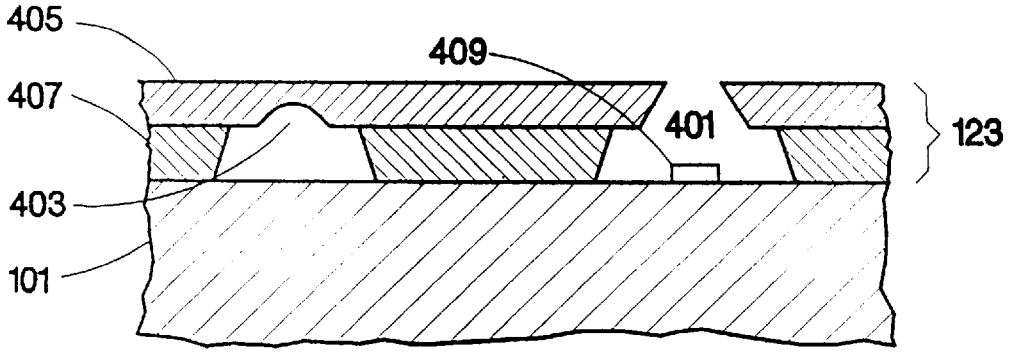
FIG. 4 is a cross sectional view B—B of a portion of the flex circuit and printhead shown in FIG. 8 illustrating how the flex circuit interacts with the base.

Returning to FIG. 1, once the heater resistors and associated interconnect circuitry are deposited on the block 101, a layer of flex circuit 123 is stretched over the printing surface and down along the sides of the printhead block 101. Thus, a large number of orifices which penetrate the flex circuit are placed on the printing surface. The flex circuit forms the orifice layer of the printhead. In the preferred embodiment, the flex circuit is manufactured from a polyimide material such as KAPTON® E, available from E. I. DuPont de Nemours and Company, but other suitable electrically insulating flexible material such as polyester or polymethylmethacrylate may also be used. In the preferred embodiment, the flex circuit has conductive traces added to the polyimide material to provide electrical interconnection between the integrated circuits housed at 109 and 111 to the groups heater resistors at 113 and 115. In the preferred embodiment, the flex circuit 123 has conductive traces conventionally made of copper, but gold or other conductive material may also be used. The flex circuit also has holes fabricated through the polyimide material by conventional laser ablation processes in order to realize 18 microns diameter orifices at spacings of 85 microns (where the orifices are located in two parallel rows), or 42 microns (where the orifices are collinear). A process of removal of flex circuit material from the flex circuit forms reference indentations of approximately 25 microns which are coordinated with the orifices and which are fabricated to fit onto the reference features, for example 119 and 121, on the base 101. Also applied to the inner surface of the flex circuit is a suitable adhesive for the KAPTON® E material which is also photodefinable and capable of being etched. The photodefining and etching process, which is well known, is used to create ink passages and ink firing chambers 401 (in FIG. 4) and expansion features 403, to be described later. When the flex circuit 123 is applied to the block 101, it is heated and pressed upon the block 101. The outer surface of the flex circuit 405 is composed of the KAPTON® E material and the inner layer 407 is composed of the photodefinable adhesive. The flex circuit ink firing chamber is formed around the firing resistor 409, its position indexed by the reference features and mating indentations in the flex circuit. As an alternative, the adhesive layer may be replaced by a layer KAPTON® F, thus forming a bilayer flex circuit.

Figure 5:
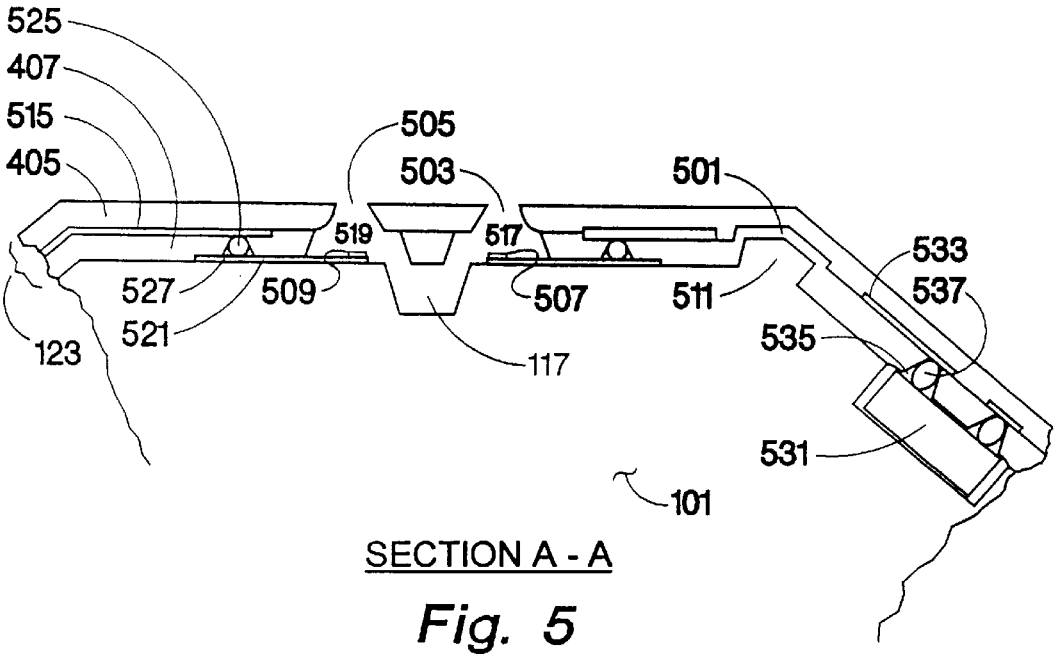
FIG. 5 is a cross sectioned view A—A of the printhead of FIG. 1.

Considering now FIG. 5, the application of the flex circuit to the base material 101 can be better understood. A cross section A—A perpendicular to the long axis of the printhead illustrates the flex circuit 123 affixed to the block 101 and illustrates the arrangement of components in the preferred embodiment. In manufacture of the printhead of the present invention, the flex circuit 123 is first applied to a center point of the print surface of block 101 and subsequently stretched simultaneously to both ends of the block 101. As the stretching occurs, alignment into the reference features, for example 119 and 121, occurs zipper-fashion from the central point of the block 101 to each end. This stretching method assures that the orifices in the flex circuit 123 are aligned over the heater resistors since the associated alignment features, reference indentations in the flex circuit, for example 501, created in the flex circuit, force alignment between the orifices 503, 505, and the heater resistors 507, 509. The indentation 501 is inserted, zipper-like, on a corresponding reference feature 511 (similar to reference features 119 and 121 of FIG. 1) on the printhead base 101. In the preferred embodiment, the flex circuit is manufactured to be approximately 2% smaller than the printhead base 101 and is manufactured to have the previously mentioned expansion features disposed across the printing surface of the block 101 so that the flex material 123 is stretched to fit the print surface of the block 101. As shown in the cross section of FIG. 5, the flex material of the preferred embodiment consists of a polyimide outer layer 405, a conductive layer 515 which is selectively deposited upon the outer layer 405, and an inner layer 407 which is photolithographically defined and conventionally etched to produce vacancies in the barrier layer material in areas around the orifices (such as areas 517 and 519 forming the firing chambers for heater resistors 507 and 509 respectively). Vacancies are also photolithographically defined and etched in the inner layer 407 so that electrical connections may be made from conductor layer 515 to other conductive layers such as a metalization 521 deposited upon the block 101 leading to heater resistor 319. In the preferred embodiment, connection is made by a solder interconnect 525 by way of via 527 in the inner layer 407. A similar interconnect is made to heater resistor 507.

In the preferred embodiment, integrated circuits, such as integrated circuit 531, are used to provide signal multiplexing and drive power to the heater resistors. Interconnection is made by way of a patterned metalization layer 533 forming conductive traces to the heater resistor 507 and electrical interconnection is made between integrated circuit 531 and metalization layer 533 by way of a via 535 in the inner layer 407 and solder interconnection 537. The preferred technique of bonding the integrated circuit 531 to the flex circuit 123 is set forth by Hayashi in "An Innovative Bonding Technique For Optical Chips Using Solder Bumps That Eliminate Chip Positioning Adjustments" IEEE Transactions on Components, Hybrids, and Manufacturing Technology, Vol. 15, No. 2, April 1992, pp. 225–230.

An ink feed channel 117 provides an ink supply to the firing chambers of the heater resistors 517, 519, and the rest of the heater resistors in the associated group (such as groups 113 and 115). The ink feed channel 117 is formed as a groove in the printhead block 101 by molding the feature into the block at the same time the reference features are created.

Figure 6:
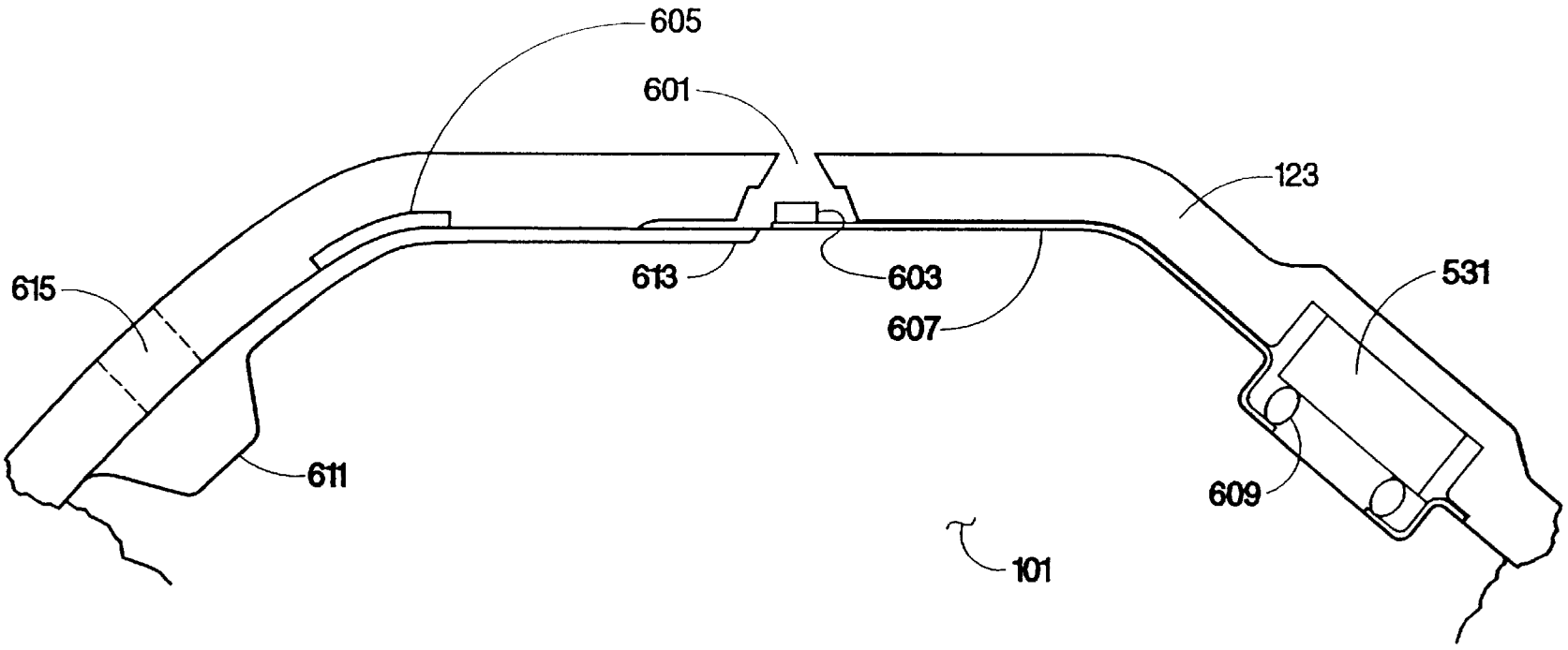
FIG. 6 is a cross section of the alternative embodiment of the large area printhead of FIG. 2.

An alternative embodiment is shown in the cross section of FIG. 6. As described above, a single row of orifices may be employed along the printing surface of the large area inkjet printhead. One orifice 601 and the associated heater resistor 603 is shown in the cross section. The orifice and its associated firing chamber is formed from the flex circuit 123, which may be a bilayer material or a single layer material having an adhesive layer. The flex circuit 123, as described previously, is first applied to the center portion of the printing surface of the block 101 and subsequently stretched simultaneously along the long axis of the block to the opposite ends. As the flex circuit is stretched, the flex circuit is fitted, zipper-like onto the reference features thereby providing mechanical referencing of the orifices in the flex circuit to the location of the heater resistors disposed on the block. Thus, the protruding reference feature 605 (having dimensions previously described) is fitted into a corresponding alignment feature depression of flex circuit 123 to properly register orifice 601 to the heater resistor 603. The flex circuit 123 and block 101 are then heated to a temperature which activates the adhesive layer or causes the inner layer of the flex circuit to bond to the surface of the block 101.

In the alternative embodiment of FIG. 6, a patterned metalization layer 607 is, conventionally deposited upon the surface of the block 101 to form conductive traces.

These conductive traces provide electrical connection between the heater resistors, the multiplexer and driver circuitry, and the input to the printhead from the printer electronic circuitry. Thus, an integrated circuit such as integrated circuit 531 which would also be used in the preferred embodiment is coupled to heater resistor 603 by way of a solder interconnection 609. Unlike the preferred embodiment, the metalization is added to the surface of the block 101 rather than being part of the flex circuit 123.

Ink is delivered to the single row of orifices/heater resistors by way of a groove or ink feed channel 613 which is fed from an ink plenum and manifold 611. In the alternative embodiment, each heater resistor is independently supplied via a separate ink feed channel. The ink plenum and manifold 611 and the ink feed channel 613 are created in the block 101 by molding at the same time as the reference features are created. The ink plenum and manifold and the ink feed channels may also be created after the block is molded by conventional etching or machining techniques. Ink is provided to the ink plenum by way of an ink inlet 615.

Figure 7:
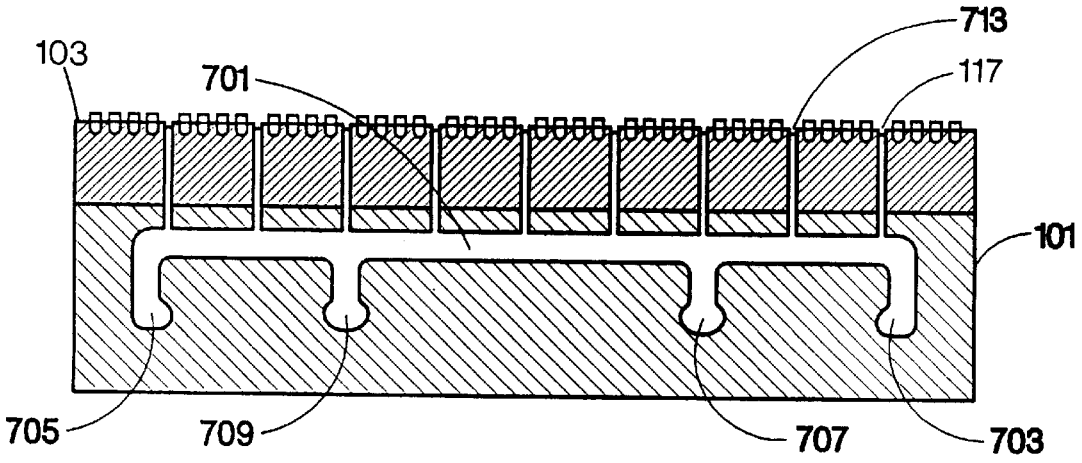
FIG. 7 is a left side elevation view of the printhead of FIG. 1 better illustrating the ink feed channels and ink manifold which may be employed in the present invention.

Viewing now FIG. 7, one may perceive the ink supply plenum 701 of the preferred embodiment molded into one side of the fused silica glass block 101. In the preferred embodiment, the ink plenum 701 is located on a side of the printhead block 101 which does not have the integrated circuits and which is not visible in FIG. 1. In the preferred embodiment the ink plenum 701 is molded to have a depth of 0.2 mm and a width of 0.5 mm. An ink inlet well 703 is disposed at one end of the ink plenum 701 and an ink outlet well 705 is disposed at the opposite end of the ink plenum 701. An additional ink inlet well 707 and an additional ink outlet well 709 may be utilized for trapped air management. Ink fill channels, for example 117 and 713, are formed in the sides and across the printing surface 103 of the block 101. A cover, not shown, is used to enclose the open portion of the ink plenum 701. A particular advantage to the ink plenum 701 molded into a side of the printhead block (which is held in a near vertical position during printer operation), is that air bubbles formed in the ink supply and in the ink fill channels 117 and 713 accumulate in the regions of the ink plenum 701 which are elevated over the ink fill channels 117 and 713. In such an orientation, air bubbles gather at the top of the ink plenum 701 and, since the ink is pressurized in the preferred embodiment, the air bubbles are swept out of the ink plenum without entering and clogging the ink feed channels 117 and 713.

Figure 8:
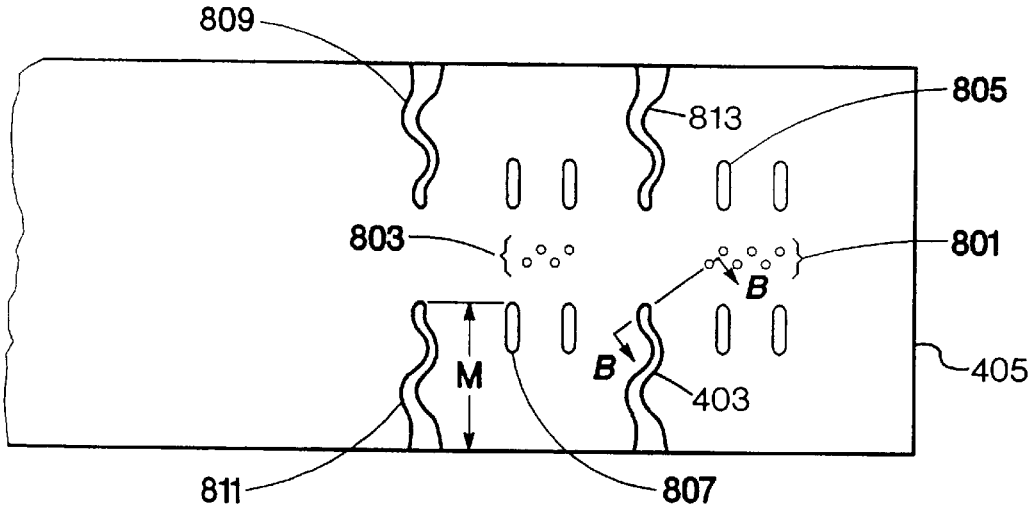
FIG. 8 is an underside view (i.e., the side disposed against the base block of the printhead) of a flex circuit which may be employed in the present invention.

FIG. 8 is a representation of the inner surface of the flex circuit 123 in which groups of orifices 801 and 803 are illustrated. This flex circuit 123 forms the orifice layer of the printhead. In order to maintain clarity, only a limited number of orifices are depicted. Further, only a limited number of reference indentations, for example indentations 805 and 807, are shown. Of particular interest are the expansion features 809, 811 and 813. These features also include and correspond to the expansion features 403 in the cross section B—B of FIG. 4. In the preferred embodiment, each expansion feature is a groove having an unflexed dimension of 1 mm wide at its narrowest point and 20 to 30 microns deep and is etched into the polyimide material in conventional fashion. The purpose of the expansion features is to provide resilience in the flex circuit 123 thereby enabling the flex circuit to expand in the long dimension and stretch to fit the printhead block 101. In the preferred embodiment, the expansion features 809 and 811 are grooves in the inner surface of the flex circuit and are disposed essentially perpendicular to the long dimension of the flex circuit. The expansion features, however, are created in a somewhat serpentine configuration about the generally perpendicular direction and are approximately twice as wide at the side edge as the expansion features are at their narrowest point near the center of the flex strip. In the preferred embodiment, the expansion features do not extend across the width of the flex circuit 123 but extend to a dimension M from the edge of the flex circuit to the inner wall of the reference indentations. In the preferred embodiment, twenty expansion features are disposed in the flex circuit not greater than 10 mm apart. While the configuration of the expansion features in the preferred embodiment provide the needed stretch performance of the flex circuit while maintaining dimensional stability in the orifice area, other expansion feature configuration, even one as simple as a straight line notch across the flex circuit may be employed.

Thus by employing a stretch-to-fit flex circuit with orifices indexed to reference indentations on the flex circuit and indexing heater resistors to reference features on a large area printhead, a page-wide printhead with mechanical and thermal stability is realized with a low cost.

We claim:

1. A printer printhead comprising:

a base having a plurality of first alignment features and a first surface having a geometric shape with a periphery and one longest dimension and one shortest dimension, said first alignment features disposed at least in part on said first surface;

at least one row of a plurality of substantially collinear heater resistors disposed essentially on said first surface of said base, essentially parallel to said one longest dimension, and in a predetermined first direct relationship with said plurality of first alignment features; and an orifice layer affixed to said first surface and having at least one expansion feature, a plurality of second alignment features, and a plurality of orifices essentially equal in number to said plurality of collinear heater resistors, said plurality of second alignment features arranged in a predetermined second direct relationship with said plurality of orifices corresponding to said predetermined first direct relationship and disposed opposite said plurality of first alignment features to align said plurality of orifices with said plurality of collinear heater resistors when said at least one expansion feature is expanded.

2. A printer printhead in accordance with claim 1 wherein said first alignment features are disposed parallel to said one longest dimension and at the periphery of said first surface.

3. A printer printhead in accordance with claim 2 wherein said base further comprises two third alignment features disposed at predetermined direct relationship to said first and second alignment features on said first surface and wherein said plurality of resistors disposed in at least one line parallel to said longest dimension collinear heater resistors further comprise heater and referenced to said two third alignment features.

4. A printer printhead in accordance with claim 1 wherein said orifice layer further comprises first and second surfaces, said first surface disposed toward a medium upon which information is to be printed and said second surface disposed facing said plurality of collinear heater resistors.

5. A printer printhead in accordance with claim 4 wherein said orifice layer further comprises a metallization layer disposed on said second surface such that said plurality of collinear heater resistors are electrically coupled to the printer.

6. A printer printhead in accordance with claim 4 wherein said orifice layer further comprises an adhesive layer disposed on portions of said second surface.

7. A printer printhead in accordance with claim 4 wherein said orifice layer further comprises a metallization layer disposed on portions of said second surface of said orifice layer and inner surface layer disposed discontinuously at least on said metallization layer, said inner surface having a ink-jet printhead function features therein.

8. A printer printhead in accordance with claim 4 wherein said expansion feature is disposed as a groove on said second surface of said orifice layer.

9. A printer printhead in accordance with claim 1 further comprising a metallization layer disposed on said first surface of said base such that said plurality of collinear heater resistors are electrically coupled to the printer.

10. A printer printhead in accordance with claim 9 wherein said printhead further comprises at least one integrated circuit disposed on a second surface of said base and couple to at least one of said plurality of collinear heater resistors via said metallization layer.

11. A printer printhead in accordance with claim 1 wherein said printhead further comprises at least one integrated circuit disposed on a second surface of said base and electrically coupled to at least one of said plurality of collinear heater resistors.

12. A printer printhead in accordance with claim 1 wherein said base further comprises first and second grooves disposed at least in said first surface and each of said first and second grooves arranged in fluid communication with at least one of respective heater resistors of said plurality of collinear heater resistors.

13. A printer printhead in accordance with claim 12 wherein said base further comprises an ink plenum disposed in a second surface adjacent said first surface and fluidically coupled to said first and second grooves such that ink is supplied to said respective heater resistors via said first and second grooves.

14. A printer printhead in accordance with claim 1 wherein said base consists of fused high silica glass.

15. A method for manufacturing a printhead for an inkjet printer comprising the steps of:

producing a base having a plurality of first alignment features disposed at least in part on a first surface of said base, said first surface having a geometric shape with one longest dimension and one shortest dimension;

depositing a plurality of substantially collinear heater resistors on said first surface of said base, essentially parallel to said one longest dimension and in a predetermined first direct relationship with said plurality of first alignment features;

forming an orifice layer having at least two surfaces, a second surface including at least one expansion feature, a plurality of second alignment features disposed on said second surface of said orifice layer, and a plurality of orifices essentially equal in number to said plurality of collinear heater resistors, each of said orifices extending through said orifice layer from said second surface to a first surface of said at least two surfaces and said at least two orifices arranged in a predetermined second direct relationship with said plurality of second alignment features corresponding to said predetermined first direct relationship; and affixing said orifice layer to said base so that said plurality of second alignment features are aligned with said plurality of first alignment features such that said at least two orifices are aligned with said plurality of collinear heater resistors when said at least one expansion feature is expanded as said orifice layer is affixed at least to said first surface of said base.

16. A method in accordance with the method of claim 15 further comprising the step of producing said first alignment features parallel to said one longest dimension and at the periphery of said first surface of said base.

17. A method in accordance with the method of claim 15 wherein said step of producing said base further comprises the step of molding two third alignment features at said first surface of said base and wherein said step of depositing said plurality of collinear heater resistors further comprises the step of depositing said heater resistors in at least one line parallel to said longest dimension and in a predetermined third direct relationship with said two third alignment features.

18. A method in accordance with the method of claim 15 wherein said step of forming said orifice layer further comprising the step of disposing a metallization layer on said second surface such that said heater resistors are electrically coupled to the printer when said orifice layer is affixed to said base.

19. A method in accordance with the method of claim 15 further comprising the step of disposing a metallization layer on said first surface of said base thereby coupling said plurality of collinear heater resistors to the printer.

20. A method in accordance with the method of claim 19 wherein further comprising the steps of disposing at least one integrated circuit on a second surface of said base and coupling said integrated circuit to at least one of said plurality of collinear heater resistors via said metallization layer.

21. A method in accordance with the method of claim 15 wherein said step forming said orifice layer further comprises the step of forming an adhesive layer on portions of said second surface.

22. A method in accordance with the method of claim 15 wherein said step of forming said orifice layer further comprises the steps of disposing a metallization layer on portions of said second surface of said orifice layer and forming an inner surface of said orifice layer discontinuously at least on portions of said metallization layer.

23. A method in accordance with the method of claim 15 further comprising the steps of attaching at least one integrated circuit to said first surface of said base and coupling said at least one integrated circuit to at least on of said plurality of collinear heater resistors via a metallization layer.

24. A method in accordance with the method of claim 15 further comprising the steps of creating first and second grooves at least in said first surface of said base and arranging said first and second grooves in fluid communication with at least one of respective heater resistors of said plurality of collinear heater resistors.

25. A method in accordance with the method of claim 24 wherein said step of producing said base further comprises the steps of creating an ink plenum groove in a second surface adjacent said first surface and fluidically coupling said ink plenum groove to said first and second grooves such that ink is supplied to respective heater resistors via said first and second grooves.

26. A method in accordance with the method of claim 15 wherein said step of forming an orifice layer further comprises the step of disposing an expansion feature as a groove on said second surface of said orifice layer.

27. A method in accordance with the method of claim 15 further comprising the step of casting said base from fused high silica glass.

28. A print cartridge for a printer comprising:

an ink-expelling apparatus including a base consisting of fused high silica glass and having a plurality of first alignment features and a printing surface having a substantially rectangular shape, said plurality of first alignment features disposed along at least one of the two long sides of said rectangular printing surface, a plurality of substantially collinear heater resistors disposed on said printing surface of said base, parallel to said two long sides of said printing surface, and in a predetermined first direct relationship with said plurality of first alignment features, and an orifice layer with an inner surface and an outer surface, consisting of a polyamide material, wherein the orifice layer is affixed to said printing surface, and said orifice layer having at least one expandable groove disposed in said inner surface, a plurality of indentations as a plurality of second alignment features disposed in said inner surface, and a plurality of orifices essentially equal in number to said plurality of collinear heater resistors disposed through said orifice layer from said inner surface to said outer surface, wherein said plurality of second alignment features are arranged in a predetermined second direct relationship with said plurality of orifices corresponding to said predetermined first direct relationship and disposed substantially opposite said plurality of first alignment features for aligning said plurality of orifices with said plurality of collinear heater resistors when said at least one expandable groove is expanded.

* * * * *